US008905152B2

(12) United States Patent
Kling et al.

(10) Patent No.: US 8,905,152 B2
(45) Date of Patent: Dec. 9, 2014

(54) SELF-POWERED FIRE HOSE FITTING FOR LIGHTING, ENVIRONMENTAL MONITORING, AND COMMUNICATIONS SYSTEM

(75) Inventors: Kenneth G. Kling, Huntington Beach, CA (US); Arthur E. Brown, Huntington Beach, CA (US)

(73) Assignee: Generation Unlimited, LLC, Huntington Beach, CA (US)

( * ) Notice: Subject to any disclaimer, the term of this patent is extended or adjusted under 35 U.S.C. 154(b) by 472 days.

(21) Appl. No.: 13/277,147

(22) Filed: Oct. 19, 2011

(65) Prior Publication Data

US 2013/0098478 A1 Apr. 25, 2013

(51) Int. Cl.
*A62C 25/00* (2006.01)
*A62C 33/00* (2006.01)

(52) U.S. Cl.
CPC ..... *A62C 33/00* (2013.01)
USPC ..... 169/52; 169/23; 169/24; 169/60; 169/70; 169/91; 239/69; 239/289; 239/525; 362/96; 362/192; 362/194; 362/555; 700/283; 340/320; 340/628; 174/47

(58) Field of Classification Search
USPC ..... 169/23, 24, 52, 54, 56, 60, 70, 91; 239/18, 69, 289, 525; 362/96, 192, 362/194, 253, 555, 800; 700/15, 17, 283; 340/320, 628; 439/191; 174/47
See application file for complete search history.

(56) References Cited

U.S. PATENT DOCUMENTS

| | | | | |
|---|---|---|---|---|
| 5,044,445 | A * | 9/1991 | Kayahara | 169/52 |
| 5,109,534 | A * | 4/1992 | Naito et al. | 169/24 |
| 5,873,647 | A * | 2/1999 | Kurtz et al. | 362/96 |
| 6,651,900 | B1 * | 11/2003 | Yoshida | 169/24 |
| 7,823,801 | B2 * | 11/2010 | McGarry et al. | 239/18 |

* cited by examiner

*Primary Examiner* — Steven J Ganey
(74) *Attorney, Agent, or Firm* — Morland C. Fischer

(57) ABSTRACT

Disclosed is a fire hose coupling apparatus for self powered lighting of an area where a fire fighter is engaged in fires suppression with a fire hose, and for providing real time environmental data to fire fighters.

18 Claims, 5 Drawing Sheets

SELF-POWERED FIRE HOSE FITTING FOR LIGHTING, ENVIRONMENTAL MONITORING, AND COMMUNICATIONS SYSTEM

FIELD OF INVENTION

This invention relates to fire-fighting equipment for use in connection with a fire hose. More specifically, an apparatus for the self powered lighting of an area where a fire fighter is engaged in fires suppression with a fire hose, and for capturing and communicating real time environmental data to fire fighters and personnel at the impacted incident.

BACKGROUND

The present disclosure generally relates to a self-power generating, lighting, data collection and display apparatuses, systems and methods used by firefighters in the firefighting environment.

Although the state of the art in firefighting has evolved significantly as technology has improved, firefighters still rely on the fire hose with a spray nozzle for extinguishing many types of fires. Often, there are situations where a firefighter may not have adequate information or lighting to effectively direct the aim of the fire hose or have the ability to readily determine the environment in which the firefighter is working. Additionally, firefighters can easily get disoriented and lose their sense of direction. For example, the firefighter may be in a burning building or fighting a forest fire at night, and being in such an environment may not be able to easily assess the environment. Therefore it is advantageous to have a light source and data gathering means available to the firefighter when fighting fires.

In many situations, the need for adequate electricity to power a light or data gathering source may not be available. Running a power cable may be impracticable as exposing a lighting fixture or electric components to water could pose a risk of an electrical shock or malfunction. Additionally, setting up a light fixture stand or the tethering of a power cable adds weight that the firefighter must manage in addition to the hose, making maneuvering clumsy and awkward. Although battery packs may be available, the consumption of power by high power luminous lighting over the time period necessary to extinguish a fire make the power storage capacity of batteries inadequate. Thus there is a need for a self-powered attached fire hose lighting system that may prove practical in the firefighting incident.

It is useful to a firefighter on the scene of a fire to have accurate real time data regarding the fire environment in which he operates. Although the firefighter is trained to evaluate the environment when approaching a fire line, sometimes it is difficult to readily assess multiple variables quickly and accurately. For example, smoke may inhibit visibility, making it impossible to see the terrain, the distance to an object, or the fastest escape route. A firefighter may find it useful to know the temperature of the ambient air or of an object to help decide a course of action, air flow, air flow direction, humidity, and thermal radiation. For example when an object has been extinguished to assess the likelihood of a reflash or the rekindling of flammable materials. An accurate measure of these variables along with determining the temperature of an object without direct contact with the object is needed.

A firefighter may also want to know information about the operational efficiency of his equipment, including air tank oxygen levels, the flow rates of fluids through and pressure within the fire hose necessary to asses or calculate reserve levels of water or retardant. The fire fighter may find it useful to know the nature or content of combustible materials, oxygen and other toxic substance levels in the air or surrounding environment. Therefore it is desirable to have multiple environmental sensors for detecting the status of environmental variables and providing reliable readily available data regarding environmental variables and objects in the environment.

Additionally, it is desirable to provide the firefighter with geographical terrain, building layout, location and routing information for an exit, escape path to the entry point of the fire or rescue. Many times, the route taken by a firefighter when entering a fire location is cut off as a result of shifting fire conditions and it becomes necessary for the firefighter to exit the same or a different entry point by an alternative route, or to send in rescuers when a firefighter is injured. Thus it is desirable to have mapping date, ability to track the location and route of the firefighter and provides terrain details both to the firefighter and any potential rescuer.

It may also be useful to provide data to other firefighters in the area, including those firefighters that are on foot, at a fire truck, or at a local command center. This information can be used by firefighters to coordinate the attack on the fire, properly allocate resources, and to execute rescues.

Therefore it is desirable to have a system that allows for improved self powered lighting, improved environmental monitoring and communication of data to firefighters. Therefore a need exists for a solution to the aforementioned problems. The present teachings provide such a system.

SUMMARY OF THE INVENTION

In view of the foregoing background, the present invention overcomes the limitations of the prior art by providing for a self-powered fire hose fitting, lighting, environmental monitoring and communication system, having a means for self generating power for down lighting and forward lighting, and also having multiple environmental detectors for measuring environmental variables, a display for presenting data to a user, and a communication means for providing data to other personnel at the impacted incident area.

In one aspect of the current invention, a fire hose fitting is disclosed with a self generating powered lighting means for providing forward lighting, down lighting, and signal lighting. The self generated power being generated using the fluid flow within the fire hose to drive an micro-hydro-turbine having magnetically charged material in proximity to an electrically conductive coil, thus generating electric current. Various embodiments of micro-turbine design are contemplated, including variations of an impeller wheel, Pelton wheel, Francis turbine and other propeller designs. The generated electricity is preferably twelve volts and stored in a battery or battery pack for use of the system when water is not flowing. However, it is contemplated that the micro-hydroturbines can generate other voltages or directly power the inventive system. It is contemplated that the generated power can be used to charge a battery pack associated with the system or the power can be used directly.

In another aspect of the current invention, the fire hose fitting system also includes a plurality of environmental & physiologic sensors that are deployed in a sensor pack or positioned into the environment for collecting data for display and communication to one or more firefighters in the affected fire area. Sensor packs can include sensors for CO, CO2, smoke particulate composition, air temperature, humidity and other environmental variables. The sensors are compartmentalized in a sensor pack carried by a firefighter. Data is also gathered from the system to evaluate performance, status and efficiency of equipment in the system. The system collects equipment status data such as fluid flow rates, internal hose pressure, air tank levels, power generation, battery charge levels, and temperature. Others are contemplated. Data such as temperature, heart rate, breathing, etc. is also gathered regarding the physiologic condition of the fire fighter. Environmental and equipment data can be transmitted to a central micro-processor through a local RF antenna or to a smart phone through a cell phone network. The data can be presented on a display disposed on the fire hose fitting or phone, and can be wirelessly communicated to other firefighters or a command center. Data is wirelessly communicated to the system for calculating hazard conditions of the fire environment and for display of data.

In another aspect of the current invention, a smart phone with installed software is utilized to receive and integrate the data gathered by the system and to calculate variables and display or communicate data to one or more firefighters, or a command center. The smart phone can be cradled onto the fire hose fitting and integrated with the fitting system to display fire fuel profiles, terrain maps, building layouts, and other useful information on a display. The smart phone app can provide GPS and mapping data and communicates with similar fitting systems used by other firefighters at the impacted incident, displaying the location of each firefighter in a fire area and providing cumulative data representing all firefighters in the firefighting theater that overlay a terrain map or building plan. The software can use sensor and equipment data to provide an overall view of the fire environment to individual firefighters and allow command center staff to monitor the fire scene and individual firefighters, and to allocate resources appropriately.

In another aspect of the current invention, GPS location data is used to determine the location of a firefighter at the fire incident and to provide escape route mapping data which can be displayed on a display associated with the fitting system or a smart phone display. The route mapping data can also be communicated to other firefighters in furtherance of a rescue. Alternatively, a short range RFID placed at an entry point when entering an area that is ablaze is in communication with the fire hose fitting system to determine the direction and distance to the entry point from the current location and display such to a firefighter to determine an escape route from the fire incident area. A user can trigger a distress signal by pressing a distress button on the sensor pack or hose fitting. The distress signal can be communicated wirelessly to the command center and other firefighters in the area. Unique mapping data can be provided to each firefighter that receives the distress call, displaying a trail or directional indicators from the current location of the receiving firefighter to the location of the distressed firefighter.

This and other objects, features and advantages are in accordance with the present invention.

BRIEF DESCRIPTION OF THE DRAWINGS

Embodiments of the present disclosure will be more readily understood by reference to the following figures, in which like reference numbers and designations indicate like elements.

DETAILED DESCRIPTION OF THE PREFERRED EMBODIMENTS

The present invention provides for a self powered fire hose lighting, environmental monitoring and communication system, having a means for self-powered generation of electricity to power the systems, down lighting, forward lighting and signal lighting. The system also including multiple detectors for measuring various environmental, equipment and physiologic variables, a display for presenting data to the user and a communication means for providing the data to the user and others at the fire incident. The system also includes a smart phone with a local resident software application used to integrate collected data and provide useful information to firefighters. The smart phone preferably has GPS and cell network capability to access network data to determine location, provide location mapping and terrain data, and to generate emergency response and rescue data.

The present invention will now be described more fully with reference to the accompanying drawings, which shows the preferred embodiments of the invention. This invention may, however, be embodied in many different forms and should not be construed as limited to the illustrated embodiments disclosed. Rather, these embodiments are provided so that this disclosure will be thorough and complete, and will fully convey the scope of the invention to those skilled in the art. Like numbers refer to like elements throughout. The monitor apparatus and methods will now be described in detail, with reference made to FIGS. 1-5.

Figure 1:
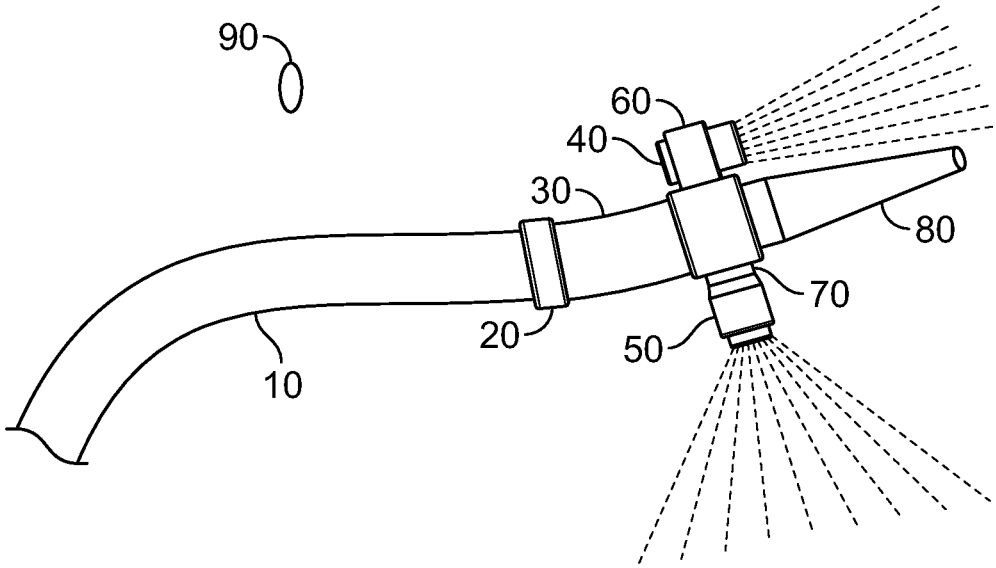
FIG. 1 illustrates one embodiment of a fire fighting hose fitting system according to the present teachings.
Figure 2:
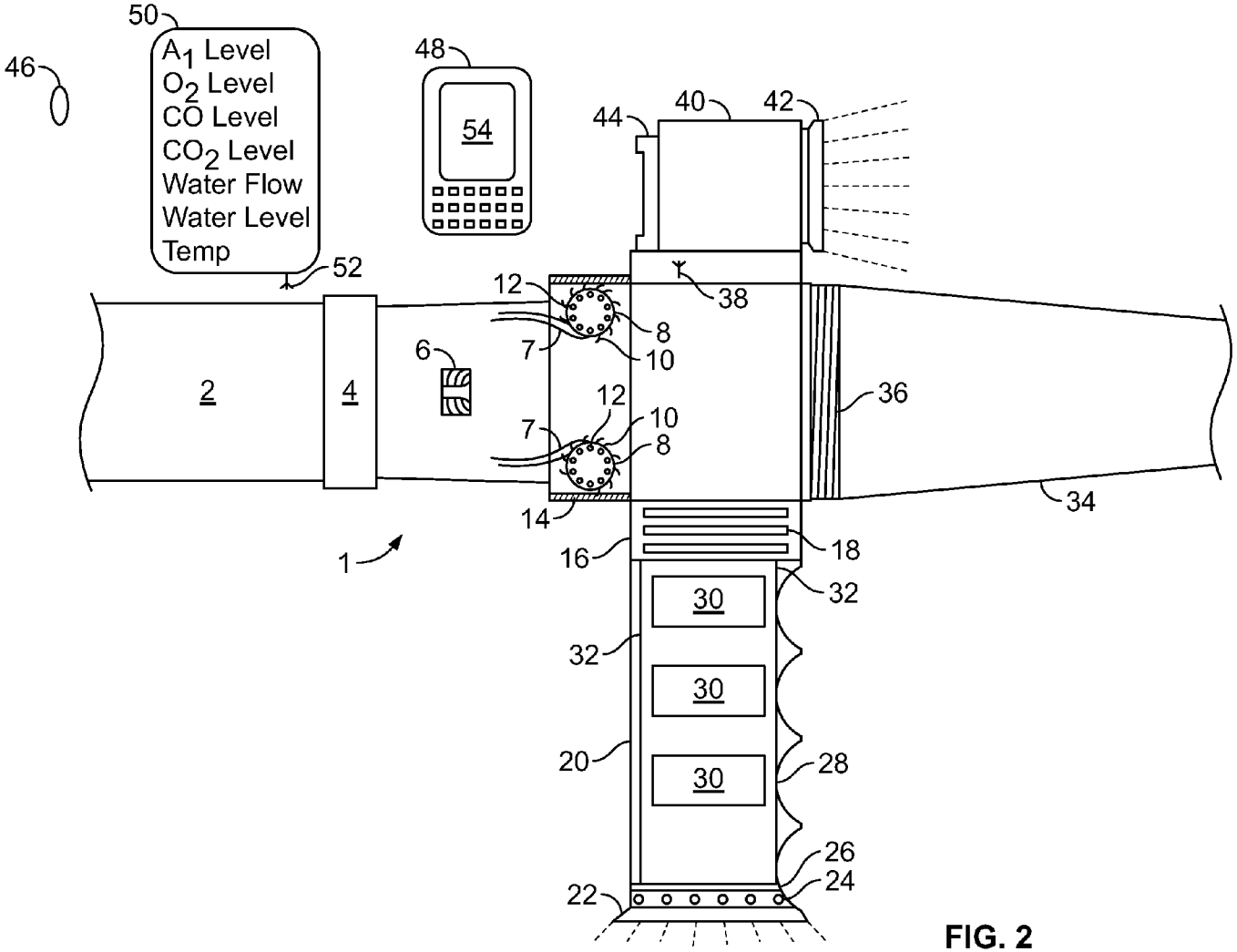
FIG. 2 illustrates one embodiment of a fire fighting hose fitting system according to the present invention.

Referring now to the drawings, where the showings are for purposes of illustrating the preferred embodiments of the invention-only and not for purposes of limiting the same. Referring to FIGS. 1 and 2, FIG. 1 provides a fire hose 10, such as a standard fire hose having an interior section that contacts water and an exterior surface. Preferred fire hoses include those having an inner hose section comprising rubber and an outer hose section comprising canvas, polyester, or any other material able to withstand the heat of a fire and that is securable to the exterior surface of the rubber hose section. The hoses also preferably have metallic or fire resistant plastic male and female hose couplings 20, so that the hoses may be coupled to a water source and/or to the couplings of other fire hoses or a fitting.

The fitting 30 of the current invention includes an interior conduit portion for allowing the flow of fluids through the interior when attached to a fire hose 10. Fluid will enter the fitting 30 where connected to the fire hose 10, flow through the fitting interior, and exit through an exit end attached to a nozzle 80. The nozzle 80 can be any standard nozzle removably attachable to the fitting 30, preferably using threads or quick release of the male and female couplings.

The fitting 30 incorporates a down light 50 for illuminating the area at the feet of the firefighter and a forward light 60 for illuminating the area forward of the exit nozzle 80. The forward light 60 may be associated with a display 40, which displays useful information to the firefighter. The down light 50 and forward light 60 are associated with a power source 70.

The power source 70 is a battery or other electric power storage device. The fitting 30 also incorporates a radio frequency (RF) transceiver in wireless communication with a radio frequency transponder 90 or other cell phone or location indication means.

FIG. 2 provides another example of the preferred embodiment of the current invention. A fire hose 2 is attached to the fire hose fitting system 1 of the current invention using a female threaded coupling 4, which is threaded to the fluid entry end of the fitting 1. The exterior of the fitting 1 preferably has an attachments means 6 for removably attaching equipment that may be useful to a fire fighter. The attachment means 6 can be any type of well know clip, clamp, Velcro®, snap, magnet or similar attachment mechanism. It is contemplated that a variety of tools can be attached at the attachment means 6.

The fire hose fitting system includes at least one spin wheel rotor means 8, mounted with bushing to interior of the casing of the fire hose fitting system. The spin wheel rotor 8 is shaped to capture kinetic vector forces from the moving water as it flows past the spin wheel rotor 8. The spin wheel can be an impeller wheel, Pelton wheel, Francis turbine or other microturbine design. Flow nozzles 9 direct forceful streams of water against a series of spoon-shaped buckets 10 mounted around the exterior top edge of a wheel rotor 8. As water is directed through a flow nozzle 9 and aimed into the bucket 10, the direction of the water and velocity changes to follow the contour of the buckets 10. When the water-jet contacts the buckets 10, the water exerts pressure on the bucket 10 and the water is decelerated as it rotates the wheel rotor 8 and flows out the other side of the bucket 10 at low velocity. The Spin wheel rotor spins as water flows past. In the process, the water's momentum is transferred to the turbine. Two buckets 10 can be mounted side-by-side, thus splitting the water jet in half. This balances the side-load forces on the wheel rotor 8, and helps to ensure smooth, efficient momentum transfer of the fluid jet to the wheel rotor 8.

The wheel rotors 8 preferably have elements of neodymium magnets 12 or other magnetic material embedded in the body of the wheel rotors 8. Copper wire 14 is wound to form a stator that is around the interior perimeter surface of the fitting system adjacent to the mounting bushings of the wheel rotors 8. The end leads of the copper windings are routed to a battery canister 16 containing rechargeable batteries 18. As the rotor wheels 8 spin, electric current is generated in the copper winding 14 and transferred to and stored in the batteries. Alternatively, the wheel rotors 8 may incorporate copper winding rather than magnets with the magnets being embedded in the casing of the fire hose fitting 1.

The fire hose fitting 1 incorporates a hand grip 20 with finger ridges and incorporating a switch 28. Preferably the hand grip 20 includes a down-light 21 at the bottom edge of the hand grip, for lighting an area at the feet of a firefighter when gripping the fitting 1. The down light preferably includes a cover lens 22, and a plurality of light emitting diodes bulbs 24. The outer body of the hand grip 20 also has a plurality of LED flasher lights 30, which can be used as emergency flashers in the event the firefighter is in distress. The down-light 21 and LED flasher lights 30 are powered by an LED engine 26 which forms part of a circuit with the batteries 18 through electric leads 32.

The fire hose fitting also incorporates a forward light housing 40, which can have alternate lens 42 configurations. In one configuration the lens 42 can be for high luminosity lighting to enhance direct night time visibility. In another configuration, fog or smoke penetrating lighting lenses may be desirable.

The forward light housing 40 includes an instrument display 44 and an RF transceiver 38. The instrument display 44 can be and LED, OLED or similar display. The RF transceiver 38 provides a wireless communication channel with a plurality of sensors capable of monitoring a variety of environmental parameters. Sensors can be mounted in a sensor pack 50, having a sensor pack RF transceiver 52 in wireless communication with the fitting RF transceiver 38. The sensor pack 50 is preferably mounted or clipped to the firefighter's protective turn out jacket. Alternatively, sensors can be distributed or positioned at key locations about the fire environment to wirelessly provide detailed information. Sensors can monitor firefighting equipment status, such as temperature, air tank levels, fluid flow through a hose, fluid reserve levels, battery levels, or voltage. Sensors can monitor a firefighter's physiological state, such as heart rate, body temperature, and respiration. The forward light is in a circuit with the battery 18 and switch 28 for powering and activating the forward light 40, the instrument display 44, and the RF transceiver 38.

Alternatively, the display may be replaced by a docking station 44 that allows for the docking of a cell phone 48 or other hand-held electronic device having a display 54. The cell phone 48 having a large display 54 and GPS location capability is preferable. A software application is loaded into the cell phone and can be used as the user interface for displaying sensor data, providing location or mapping data of the terrain and other firefighters in the area. The cell phone app can also send periodic or real time data that has been collected from sensors to a command center. The cell phone app can receive mapping and terrain or building diagram information to assist the firefighter in navigating about the fire area.

Figure 3:
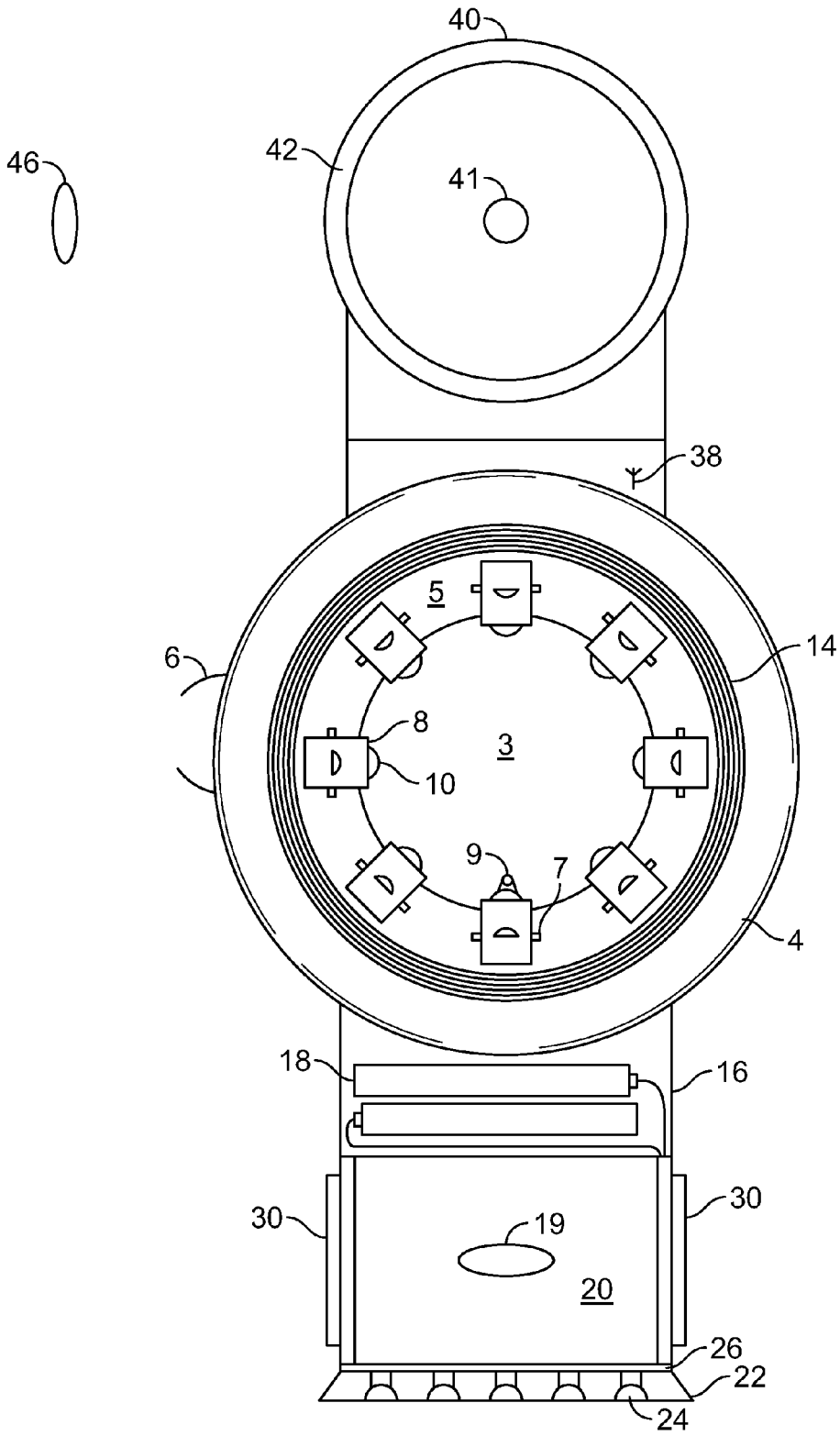
FIG. 3 is a front sectional representation of a fire fighting hose fitting of the present teachings.

Now with reference to FIG. 3, FIG. 3 shows a front sectional view of the fire hose fitting of the current invention. The fitting has an interior conduit portion 5 for allowing a fluid to flow through the fitting. A threaded coupling 4 allows for the attachment of a nozzle, which can be any standard or brass nozzle that is well known in the art.

A mounting bushing 5 has mounted a plurality of Pelton wheel type spin wheel rotors 8, each spin wheel rotor having a plurality of spoon shaped buckets 10 and rotating about a center axis rod 7 attached to the mounting bushing 5. The mounting bushing 5 also having a plurality of small interior flow nozzles 9 for directing a flow of fluid at the buckets 10. As water flows through the fitting conduit portion 5, a small amount of water is diverted through a plurality of small interior flow nozzles 9 directed at the spin wheel rotors buckets 10. Flow nozzles 9 direct forceful streams of water against the buckets 10 mounted around the exterior top edge of a wheel rotor 8. As water is directed through a nozzle 9 and flows into the bucket 10, the direction of the water and velocity changes to follow the contour of the buckets 10 and the water-jet contacts the buckets 10, the water exerts pressure on the bucket 10, creating rotational force on the spin wheel 8. The spin wheel rotor 8 spins as water flows past.

Adjacent to the mounting bushing 5 is a copper winding 14 with leads to rechargeable batteries 18 located within a battery canister 16. As the spin wheel rotors 8 rotate, magnets (not shown in FIG. 3) embedded in the spin wheel rotor 8 generate an electric current within the copper windings, which is stored in the rechargeable batteries 18.

Associated with the battery canister 16 is a hand grip 20 for holding the fitting. The hand grip 20 having a down light lens 22 covering a plurality of LED lights 24 associated with an LED light engine 26. The hand grip 20 also having a plurality of signal lights 30 and a switch 19. The switch 19 being part of a circuit for providing power from the batteries 18 to the LED engine 26, the forward light, the signal lights 30, and the other electronics of the system.

Also associated with the fitting 1 is a forward light housing 40 containing a forward light lamp 41 covered by a lens 42, an RF transceiver 38, and a display (not show). The transceiver 38 is in wireless communication with a sensor pack or other short range transponder 46. In an alternate embodiment the display can be replace with a cradle for docking a cellular phone.

Figure 4A:
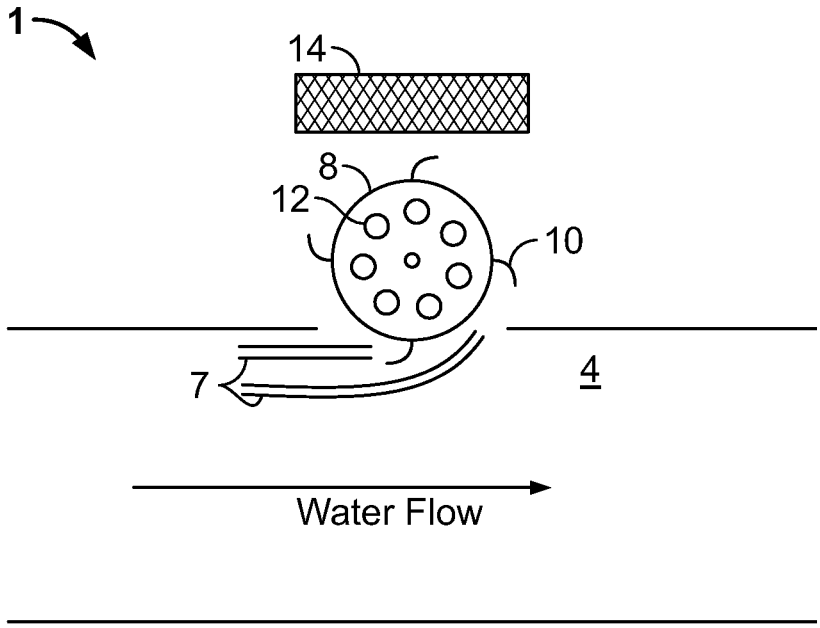
FIG. 4A is a diagrammatic representation of the profile a fire fighting hose fitting Pelton wheel structure of the present teachings.
Figure 4B:
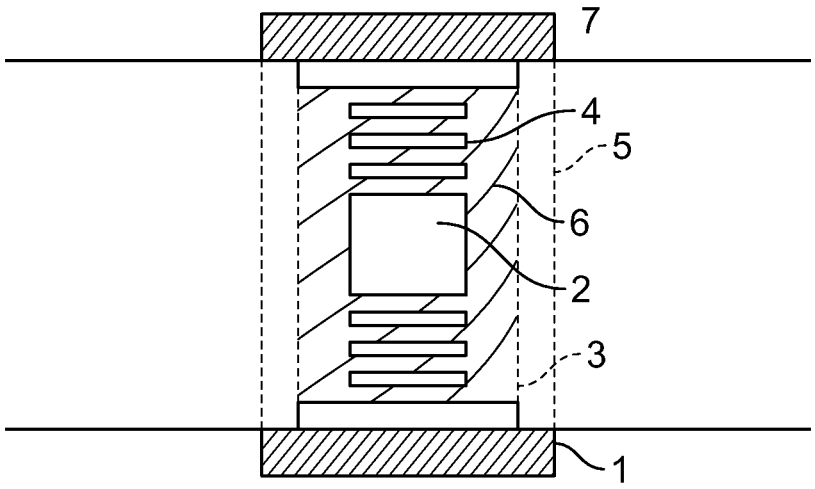
FIG. 4B is a diagrammatic cross sectional representation of an alternative embodiment of a fire fighting hose fitting hydro-turbine of the present teachings.
Figure 5:
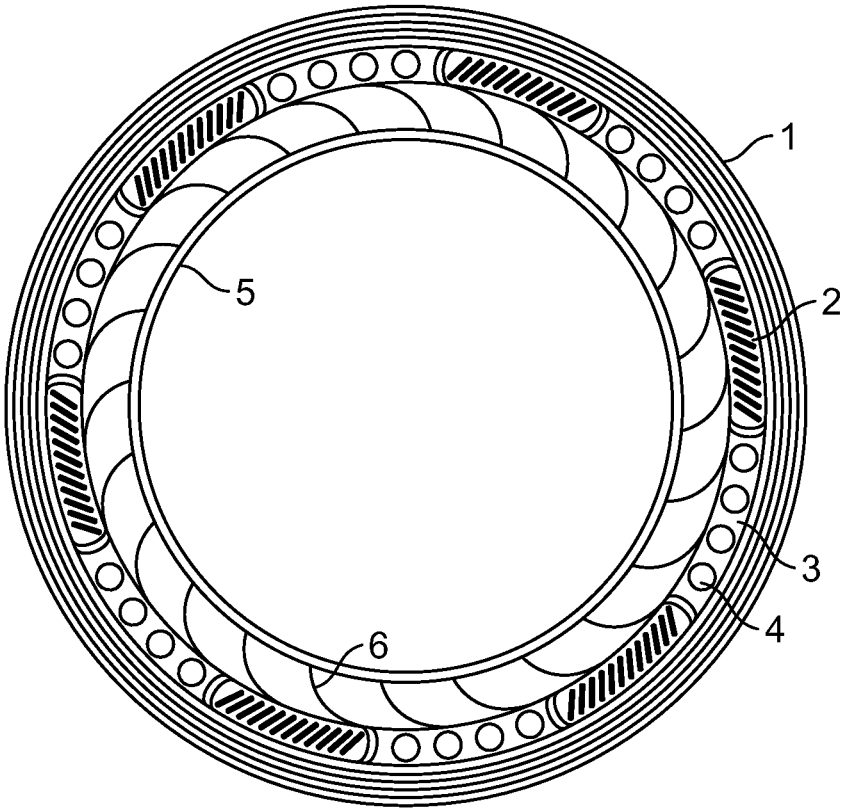
FIG. 5 is a diagrammatic front view representation of an alternative embodiment of a fire fighting hose fitting hydro-turbine of the present teachings.

FIG. 4A show a schematic profile view of the interior conduit 4 of the fitting 1 with the direction of water flow through the conduit 4 indicated. As water flows through the conduit, flow nozzles 6 are aimed at the buckets 10 of the spin wheel rotor 8. Magnets 12 are embedded within the body of the rotor 8. As water passes through the flow nozzles 6 and pushes the buckets 10 causing rotational motion of the spin wheel rotor 8, electric current is generated in an adjacent copper coil 14. FIGS. 4B and 4C are an example of an alternative embodiment of the power generation mechanism of the current invention. In this embodiment, a housing a column bearing housing 5 contains a bearing ring 3 with column shaped roller bearings 4 and neodymium magnets 2. The interior surface of the bearing race has a plurality of turbine blades 6 set at oblique angles to the cross section of the conduit. A copper coil 1 is wound about the perimeter of the exterior edge of the conduit adjacent to the bearing housing. As water flows through the interior it flows past the turbine blades 6 causing the bearing housing to rotate. As the magnets move along the copper winding electrical current is generated.

While the above description has pointed out novel features of the present disclosure as applied to various embodiments, the skilled person will understand that various omissions, substitutions, permutations, and changes in the form and details of the present teachings may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. While the above description has pointed out novel features of the present disclosure as applied to various embodiments, the skilled person will understand that various omissions, substitutions, permutations, and changes in the form and details of the present teachings may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art.

The invention claimed is:

1. A hose fitting apparatus, comprising;

A conduit having a fluid entry end and a fluid exit end;

A coupling for releasably attaching the fluid entry end of said conduit to the discharge end of a hose;

Means for generating electric power, whereby electric power is generated by movement of a magnet in proximity to a conductive coil, said movement caused by the flow of fluid through the conduit from the fluid entry end to the fluid exit end;

A battery for storing the electric power generated by said means for generating electric power;

At least one light source in an electrical circuit with said battery;

At least one of sensor for detecting;

At least one means for determining location;

A display for presenting information; and

Means for wireless communication to or receiving communications from a location remote from the fitting.

2. The hose fitting apparatus of claim 1, wherein said means for generating electric power further comprises an impeller wheel with a plurality of buckets for interfacing with the fluid as it flows through the conduit from the entry end to the exit end causing the wheel to spin.

3. The hose fitting apparatus of claim 1, wherein the means for generating electric power is mounted in a nozzle releasably attached to the fluid exit end of the conduit.

4. The hose fitting apparatus of claim 1, wherein the light source further comprises an LED lighting source that illuminates the footing area of the user of the hose.

5. The hose fitting apparatus of claim 1, wherein the light source further comprises an LED lighting source that illuminates the area forward of the user of the hose.

6. The hose fitting apparatus of claim 1, wherein the light source further comprises a color status indicator of the condition of the user of the hose.

7. The hose fitting apparatus of claim 1, wherein the light source further comprises an laser lighting source for determining the distance to a specific object.

8. The hose fitting apparatus of claim 1, wherein the light source further comprises a switch for changing the condition of the light source from on to off, or to change the color of light from the color status indicator.

9. The hose fitting apparatus of claim 1, wherein the at least one sensor further comprises a plurality of sensors that monitors the fitting's performance, among variable including internal hose pressure, fluid flow rate, power generation, and battery charge level.

10. The hose fitting apparatus of claim 1, further comprises a sensor pack placed with a user wherein the at least one sensor is a CO, CO2, smoke particulate composition, air temperature, humidity, user body temperature, heart rate, or breathing rate.

11. The hose fitting apparatus of claim 1, wherein said means for determining location comprises a global positioning system or a short range radio frequency identification system.

12. The hose fitting apparatus of claim 1, wherein the at least one sensor further comprises a plurality of sensors that displays geographical terrain, building layout, location and routing information for an exit, escape path to the entry point of the fire or rescue.

13. The hose fitting apparatus of claim 1, further comprising a dock for docking the display and wherein the display is removable and in wireless communication with the fitting when removed from said dock.

14. The hose fitting apparatus of claim 1, wherein the means for wireless communication is a smart phone in communication with a cellular network, and capable of providing data to other firefighters in the area, including those firefighters that may be on foot, at a fire truck, or at a local command center.

15. The hose fitting apparatus of claim 1, wherein the means for wireless communication is a smart phone in communication with a cellular network, and wherein hazard conditions of the fire environment can be received from the cellular network presented on said display.

16. The hose fitting apparatus of claim, 1, wherein the means for wireless communication is a smart phone in communication with a cellular network, and wherein the user can trigger a distress signal by pressing a distress button on the sensor pack or hose fitting that is communicated to other firefighters in the area, at a fire truck, or at a local command center.

17. The hose fitting apparatus of claim 1, wherein the means for wireless communication is a smart phone in communication with a cellular network and wherein the smart phone receives unique mapping data in response to a distress call, displaying a trail or directional indicators from the current location of the receiving firefighter to the location of the distressed firefighter.

18. The hose fitting apparatus of claim 1, wherein the means for wireless communication is a smart phone in communication with a cellular network, wherein the smart phone is cradled onto the fire hose fitting and includes a display and is capable of providing fire fuel profiles, terrain maps, building layouts, and other useful information, GPS and mapping data and further communicates with similar fitting systems used by other firefighters in the area, displaying the location of each firefighter in a fire area and providing cumulative data representing all firefighters in the firefighting theater that overlay a terrain map or building plan.

* * * * *